US006816168B2

(12) United States Patent
Kumada et al.

(10) Patent No.: US 6,816,168 B2
(45) Date of Patent: Nov. 9, 2004

(54) IMAGE PROCESSING METHOD, APPARATUS AND SYSTEM

(75) Inventors: Shuichi Kumada, Kanagawa (JP); Ayako Sano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 226 days.

(21) Appl. No.: 09/966,250

(22) Filed: Oct. 1, 2001

(65) Prior Publication Data

US 2002/0039103 A1 Apr. 4, 2002

(30) Foreign Application Priority Data

Oct. 4, 2000 (JP) ..... 2000-305371

(51) Int. Cl.[7] ..... G09G 5/02

(52) U.S. Cl. ..... 345/589; 345/591; 345/593; 345/597; 345/604

(58) Field of Search ..... 345/589, 591, 345/597, 604, 593

(56) References Cited

U.S. PATENT DOCUMENTS 5,940,192 A * 8/1999 Ichikawa et al. ..... 358/530

* cited by examiner

*Primary Examiner*—Matthew C. Bella
*Assistant Examiner*—Tam Tran
(74) *Attorney, Agent, or Firm*—Fitzpatrick, Cella, Harper & Scinto

(57) ABSTRACT

When color matching using CIECAM97s is carried out, it is required that the characteristics of lighting conditions be detected simply and accurately. In a conventional method of detecting lighting conditions, accurate characteristic values cannot be detected if the user selects lighting conditions of a variety of types sensorially. If detection is performed directly by a photometric sensor, on the other hand, apparatus having a complicated structure is required. According to the invention, therefore, the rated-product number of a lighting lamp is input, a lighting characteristic value is calculated based upon the rated-product number, and color matching processing is executed using a color appearance model that is based upon the lighting characteristic value. As a result, lighting characteristics can be detected simply and accurately and it is possible to execute color matching processing using a color appearance model that takes lighting into account.

22 Claims, 8 Drawing Sheets

| | | | | | TYPICAL CHARACTERISTIC VALUES OF COMMERCIALLY AVAILABLE FLUORESCENT LAMPS | | |
|---|---|---|---|---|---|---|---|
| | | | | LIGHT-COLOR SYMBOLS | TYPICAL VALUE OF CORRELATED COLOR TEMPERATURE | TYPICAL VALUE OF Ra | TYPICAL VALUE OF LUMINOUS FLUX |
| FOR GENERAL LIGHTING | HIGH-EFFICIENCY COLOR RENDERING TYPE | | BULB COLOR | EX-L | 3000 | 88 | 3560 |
| | | | WARM WHITE COLOR | EX-WW | 3500 | 88 | 3200 |
| | | | WHITE COLOR | EX-W | 4000 | 88 | 3200 |
| | | | DAYLIGHT WHITE COLOR | EX-N | 5000 | 88 | 3560 |
| | | | DAYLIGHT COLOR | EX-D | 6700 | 88 | 3350 |
| | HIGH COLOR RENDERING TYPE | AAA | BULB COLOR | L-EDL | 3000 | 95 | 1730 |
| | | | DAYLIGHT WHITE COLOR | N-EDL | 5000 | 99 | 2250 |
| | | | DAYLIGHT COLOR | D-EDL | 6500 | 98 | 1800 |
| | | AA | WHITE COLOR | W-SDL | 4500 | 91 | 1980 |
| | | | DAYLIGHT WHITE COLOR | N-SDL | 5000 | 92 | 1980 |
| | | | DAYLIGHT COLOR | D-SDL | 6500 | 94 | 1950 |
| | ORDINARY TYPE | | BULB COLOR | LE | 2940 | 84 | 1070 |
| | | | WARM WHITE COLOR | WW | 3450 | 60 | 3010 |
| | | | WHITE COLOR | W | 4150 | 61 | 3100 |
| | | | DAYLIGHT WHITE COLOR | N | 5000 | 72 | 2950 |
| | | | DAYLIGHT COLOR | D | 6500 | 74 | 2700 |

FIG. 1

| | | | JIS STANDARD VALUES | | |
|---|---|---|---|---|---|
| | | | LIGHT-COLOR SYMBOLS | RANGE OF CORRELATED COLOR TEMPERATURES | Ra MINIMUM VALUE |
| HIGH-EFFICIENCY COLOR RENDERING TYPE | | BULB COLOR | EX-L | 2600~3150K | 80 |
| | | WARM WHITE COLOR | EX-WW | 3200~3700K | 80 |
| | | WHITE COLOR | EX-W | 3900~4500K | 80 |
| | | DAYLIGHT WHITE COLOR | EX-N | 4600~5400K | 80 |
| | | DAYLIGHT COLOR | EX-D | 5700~7100K | 80 |
| HIGH COLOR RENDERING TYPE | AAA | BULB COLOR | L-EDL | 2600~3150K | 90 |
| | | DAYLIGHT WHITE COLOR | N-EDL | 4600~5400K | 95 |
| | | DAYLIGHT COLOR | D-EDL | 5700~7100K | 95 |
| | AA | WHITE COLOR | W-SDL | 3900~4500K | 84 |
| | | DAYLIGHT WHITE COLOR | N-SDL | 4600~5400K | 86 |
| | | DAYLIGHT COLOR | D-SDL | 5700~7100K | 88 |
| ORDINARY TYPE | | BULB COLOR | LE | 2600~3150K | 50 |
| | | WARM WHITE COLOR | WW | 3200~3700K | 54 |
| | | WHITE COLOR | W | 3900~4500K | 57 |
| | | DAYLIGHT WHITE COLOR | N | 4600~5400K | 67 |
| | | DAYLIGHT COLOR | D | 5700~7100K | 69 |

FIG. 2

| | | | | | TYPICAL CHARACTERISTIC VALUES OF COMMERCIALLY AVAILABLE FLUORESCENT LAMPS | | |
|---|---|---|---|---|---|---|---|
| | | | | LIGHT-COLOR SYMBOLS | TYPICAL VALUE OF CORRELATED COLOR TEMPERATURE | TYPICAL VALUE OF Ra | TYPICAL VALUE OF LUMINOUS FLUX |
| FOR GENERAL LIGHTING | HIGH-EFFICIENCY COLOR RENDERING TYPE | | BULB COLOR | EX-L | 3000 | 88 | 3560 |
| | | | WARM WHITE COLOR | EX-WW | 3500 | 88 | 3200 |
| | | | WHITE COLOR | EX-W | 4000 | 88 | 3200 |
| | | | DAYLIGHT WHITE COLOR | EX-N | 5000 | 88 | 3560 |
| | | | DAYLIGHT COLOR | EX-D | 6700 | 88 | 3350 |
| | HIGH COLOR RENDERING TYPE | AAA | BULB COLOR | L-EDL | 3000 | 95 | 1730 |
| | | | DAYLIGHT WHITE COLOR | N-EDL | 5000 | 99 | 2250 |
| | | | DAYLIGHT COLOR | D-EDL | 6500 | 98 | 1800 |
| | | AA | WHITE COLOR | W-SDL | 4500 | 91 | 1980 |
| | | | DAYLIGHT WHITE COLOR | N-SDL | 5000 | 92 | 1980 |
| | | | DAYLIGHT COLOR | D-SDL | 6500 | 94 | 1950 |
| | ORDINARY TYPE | | BULB COLOR | LE | 2940 | 84 | 1070 |
| | | | WARM WHITE COLOR | WW | 3450 | 60 | 3010 |
| | | | WHITE COLOR | W | 4150 | 61 | 3100 |
| | | | DAYLIGHT WHITE COLOR | N | 5000 | 72 | 2950 |
| | | | DAYLIGHT COLOR | D | 6500 | 74 | 2700 |

IMAGE PROCESSING METHOD, APPARATUS AND SYSTEM

FIELD OF THE INVENTION

The present invention relates to an image processing apparatus, method and system for performing color matching that takes lighting characteristics into consideration.

BACKGROUND OF THE INVENTION

In a conventional CMS (Color Management System), color matching is implemented by using a device-independent color space, such as an XYZ or L*a*b* color system defined by the CIE (International Committee for the study of Lighting and Color). This color matching is based upon the idea that if two colors are described by identical coordinates in the same color space, then the appearance of the two colors will match. However, the assurance of color matching in this color space is premised on the fact that both of the compared color images are observed under identical lighting conditions.

Recently, CIECAM97s (CAM stands for Color Appearance Model) has been proposed by the CIE as a new color system that solves the above problem. An example of color matching based upon this color system is shown in FIG. 8. It will be understood from FIG. 8 that an output image Xr, Yr, Zr that is the result of correcting a disparity in lighting conditions is eventually obtained by inputting lighting conditions with respect to tristimulus values X, Y, Z of an input image indicated by "Sample" at the top center of the diagram, where the lighting conditions are lighting conditions (indicated on the right side) for observing the input image and lighting conditions (indicated on the left side) for observing the output image.

The lighting conditions in this color system have the following as parameters: relative tristimulus values Xw, Yw, Zw of the illuminating lamp, luminance La of the adaptation visual field (a value which is 20% of the absolute luminance of the adaptation visual field), and relative luminance Yb of the background (reflectivity of N5 in the Munsell color system). In FIG. 8, "r" is appended to the end of the parameters of the lighting conditions for observing the output image.

Generally, in order to implement the color matching shown in FIG. 8 in a color management system that uses CIECAM97s, a viewing condition tag that stores the characteristics of lighting conditions is provided in a device profile that is based upon the ICC (Inter Color Consortium) format, and color conversion processing in accordance with these lighting conditions is executed.

In a case where color matching using CIECAM97s is thus carried out, it is necessary to detect the parameters (characteristics) of the lighting conditions simply and accurately, and methods of performing such detection have been proposed.

For example, the specification of Japanese Patent Application Laid-Open No. 11-232444 discloses a method (simple setting method) in which any one of a plurality of profiles prepared in advance by limiting luminance and color temperature as observed lighting conditions is selected sensorially by the user employing the user interface of utility software.

In another example, the specification of Japanese Patent Application Laid-Open No. 9-214787 discloses a method (photometric sensor method) in which the characteristic values of lighting conditions are sensed directly by a photometric sensor.

However, the conventional methods of detecting lighting conditions involve certain problems. Specifically, with the conventional simple setting method, the lighting conditions that can be selected are limited to several types and a sensorial selection is made by the user. As a consequence, an error develops between these characteristic values and the characteristic values of the actual lighting conditions and detecting accurate characteristic values is not possible.

The photometric sensor method, on the other hand, is superior in terms of detection precision but the sensor apparatus is complicated in structure and lacks simplicity.

SUMMARY OF THE INVENTION

The present invention has been proposed to solve the problems of the prior art and has as its object to provide an image processing apparatus capable of detecting, simply and accurately, lighting characteristics used in color matching processing that employs a color appearance model.

According to the present invention, the foregoing object is attained by providing an image processing method for executing correction processing using a color appearance model, comprising: a rated-product number input step of inputting a rated-product number of a lighting lamp; a lighting characteristic calculation step of calculating lighting characteristic values based upon the rated-product number; and a correction step of executing correction processing that uses a color appearance model that is based upon the lighting characteristic values.

Another object of the present invention is to so arrange it that appropriate color matching processing can be executed in conformity with detected lighting characteristics.

According to the present invention, the foregoing object is attained by providing an image processing method for executing correction processing using a color appearance model, comprising: an input step of inputting illumination-light source conditions and indoor lighting environment conditions; a lighting characteristic calculation step of calculating a lighting characteristic value based upon the illumination-light source conditions and the indoor lighting environment conditions; and a correction step of executing correction processing that uses a color appearance model that is based upon the lighting characteristic value.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 1 is a diagram illustrating an example of classes of fluorescent lamps, which are based upon light-source color and color rendering, and standard values thereof;

FIG. 2 is a diagram illustrating an example of typical characteristic values of a fluorescent lamp available on the market;

DETAILED DESCRIPTION OF THE PREFERRED EMBODIMENT

A preferred embodiment of the present invention will now be described in detail in accordance with the accompanying drawings.

As mentioned above, the object of this embodiment is to detect, simply and accurately, lighting characteristics used in color matching processing that employs a color appearance model and execute appropriate color matching processing that conforms to the lighting characteristics detected. To accomplish this, it is necessary to detect characteristic values of lighting appropriately and feed these values back to color matching processing.

<Fluorescent-lamp Characteristics>

Figure 8:
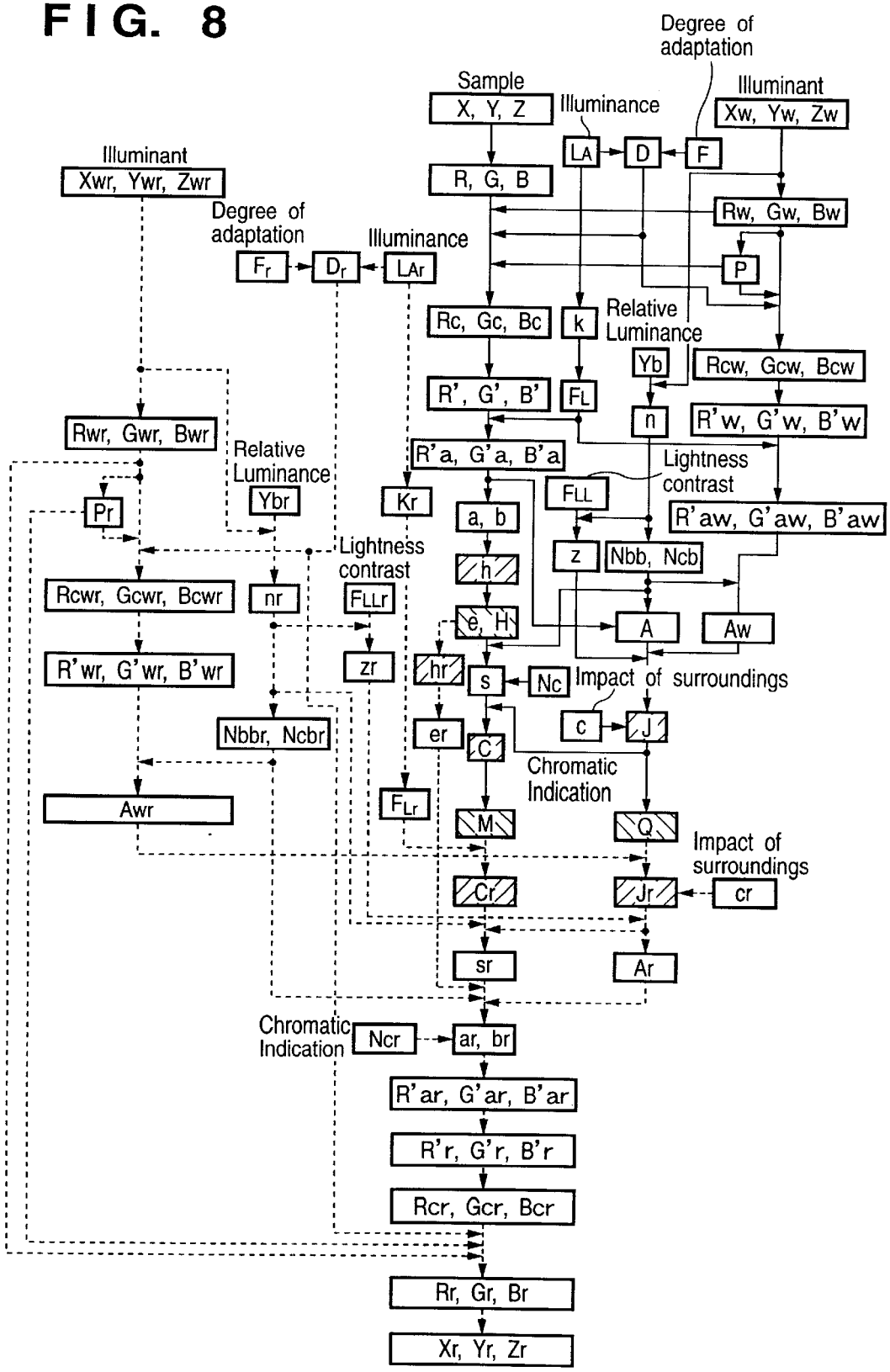
FIG. 8 is a diagram illustrating color matching processing in a CIECAM97s color system.

Before a method of detecting lighting characteristics according to this embodiment is described, the characteristics of a fluorescent lamp used as ordinary lighting will be explained. An example in which the relative tristimulus values Xw, Yw, Zw of lighting and the luminance La (cd/$m^2$) of the adaptation visual field (see FIG. 8) are used as the characteristic values of lighting will be described below. However, the facts of this embodiment hold similarly also in a case where the color temperature (K) of lighting and the illuminance (lux) of the adaptation visual field are used. Further, in this embodiment, an example using a fluorescent lamp stipulated in JIS C7601 based upon an ordinary office lighting standard (The Illuminating Engineering Institute of Japan: Indoor Lighting Standard) will be described. However, this embodiment is applicable to other lighting lamps as well.

FIG. 1 is a diagram illustrating an example of classes of fluorescent lamps, which are based upon light-source color and color rendering, and the standard values thereof as specified by JIS Z9112. Ordinary fluorescent lamps are thus classified and organized by light-color symbols on the basis of spectral-distribution characteristics and color rendering evaluation values possessed by a fluorescent body.

Fluorescent lamps actually available on the market have a "rated-product number" indication, an example of which is as follows:

FLR4OSS·EX-N/M

In this example of a rated-product number, the underlined portion "EX-N" is the light-color symbol. It is mandated by JIS C7601 that a fluorescent lamp have such a light-color symbol indication.

Further, lighting manufacturers release the characteristic values of their lighting lamps as a table of rated characteristics, as shown in FIG. 2. The characteristic values of these manufacturers generally agree for each light-color symbol.

Thus, by referring to the light-color symbol set forth in the rated-product number of a commercially available fluorescent lamp, one can determine the correlated color temperature (K) and luminous flux (lm) of the fluorescent lamp.

<System Configuration of this Embodiment>

Figure 3:
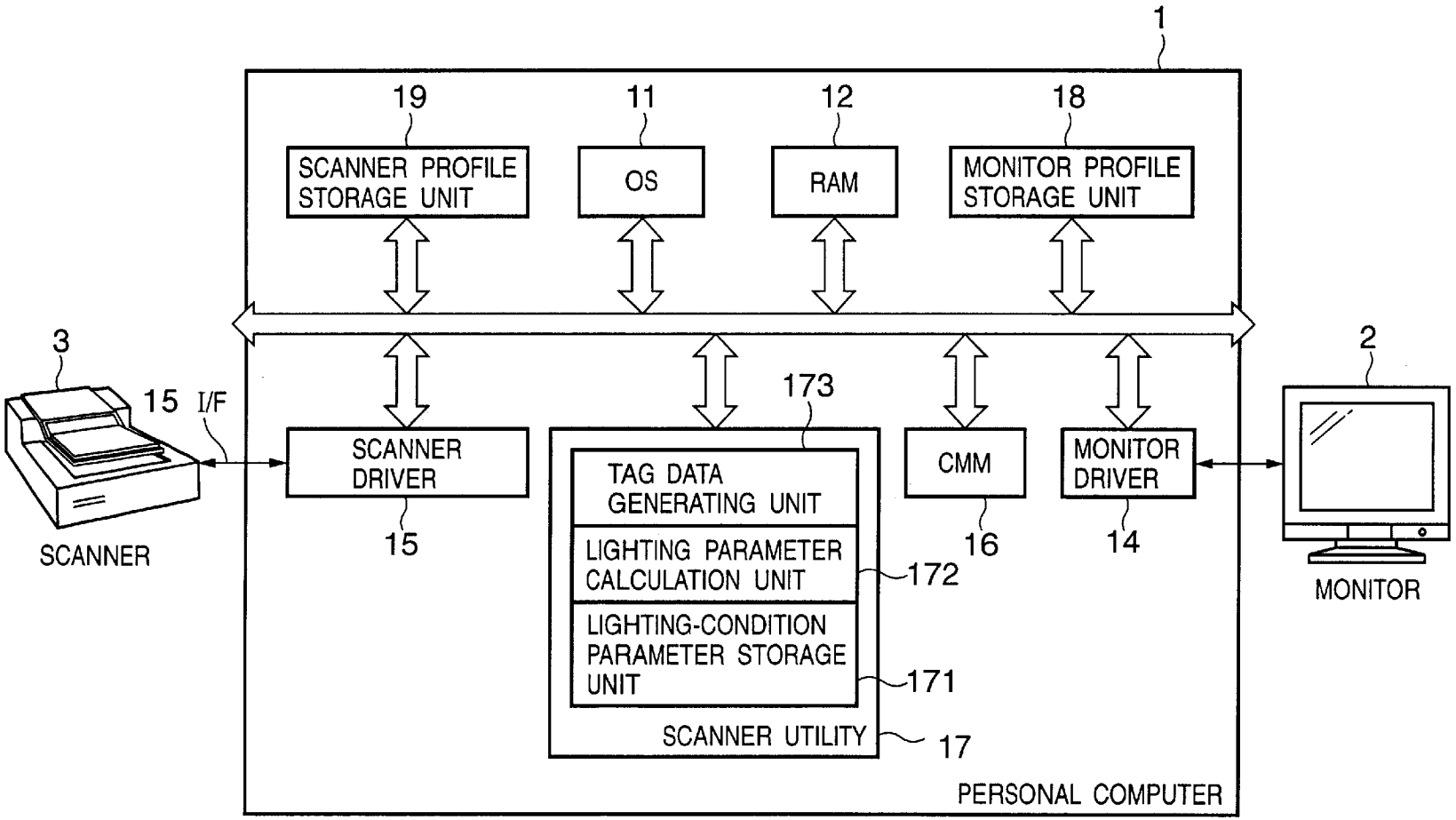
FIG. 3 is a block diagram illustrating the configuration of a system according to this embodiment.

FIG. 3 is a block diagram illustrating the general structure of a system to which this embodiment is applied. This system comprises a personal computer 1, a monitor 2 and a scanner 3. This embodiment is characterized in that by reading printed matter using the scanner 3 and executing color matching processing, an image of the printed matter is displayed on the monitor 2 in a color substantially the same as that of the actual printed matter.

The personal computer 1 has an operating system (OS) 11, for which such devices as a CPU and VRAM necessary for presenting a monitor display and for image processing are provided, that provides the basic function necessary to run software such as application software; a RAM 12 used as a work area for various utilities; an image data storage unit 13 in which image data is stored; a monitor driver 14 for controlling the display of data on the monitor 2; an interface 15 for connecting the scanner 3 and the personal computer 1; a color matching module (CMM) 16 for executing color matching processing; a scanner utility 17 for controlling scanner-data input processing, e.g., for generating tag data of a profile concerning the scanner 3; a monitor profile storage unit 18 in which the profile of monitor 2 has been stored; and a scanner profile storage unit 19 in which the profile of scanner 3 is stored.

In this embodiment, an example in which the standard profile (D65, 80 cd/$m^2$) of an sRGB monitor is applied as the monitor profile will be described. However, if the monitor is a monitor profile in which luminance information has been defined in the tag data, then the profile is applicable to this embodiment.

The scanner utility 17 is internally provided with a lighting-condition parameter storage unit 171 that stores lighting characteristic values (e.g., light-color symbols and values corresponding to these symbols shown in FIG. 2) for a plurality of light-color symbols of a fluorescent lamp; a lighting parameter calculation unit 172 for calculating characteristic values of optimum lighting based upon light-color symbols selected by the user; and a tag data generating unit 173 for generating tag data of the scanner profile based upon the calculated characteristic values.

Figure 4:
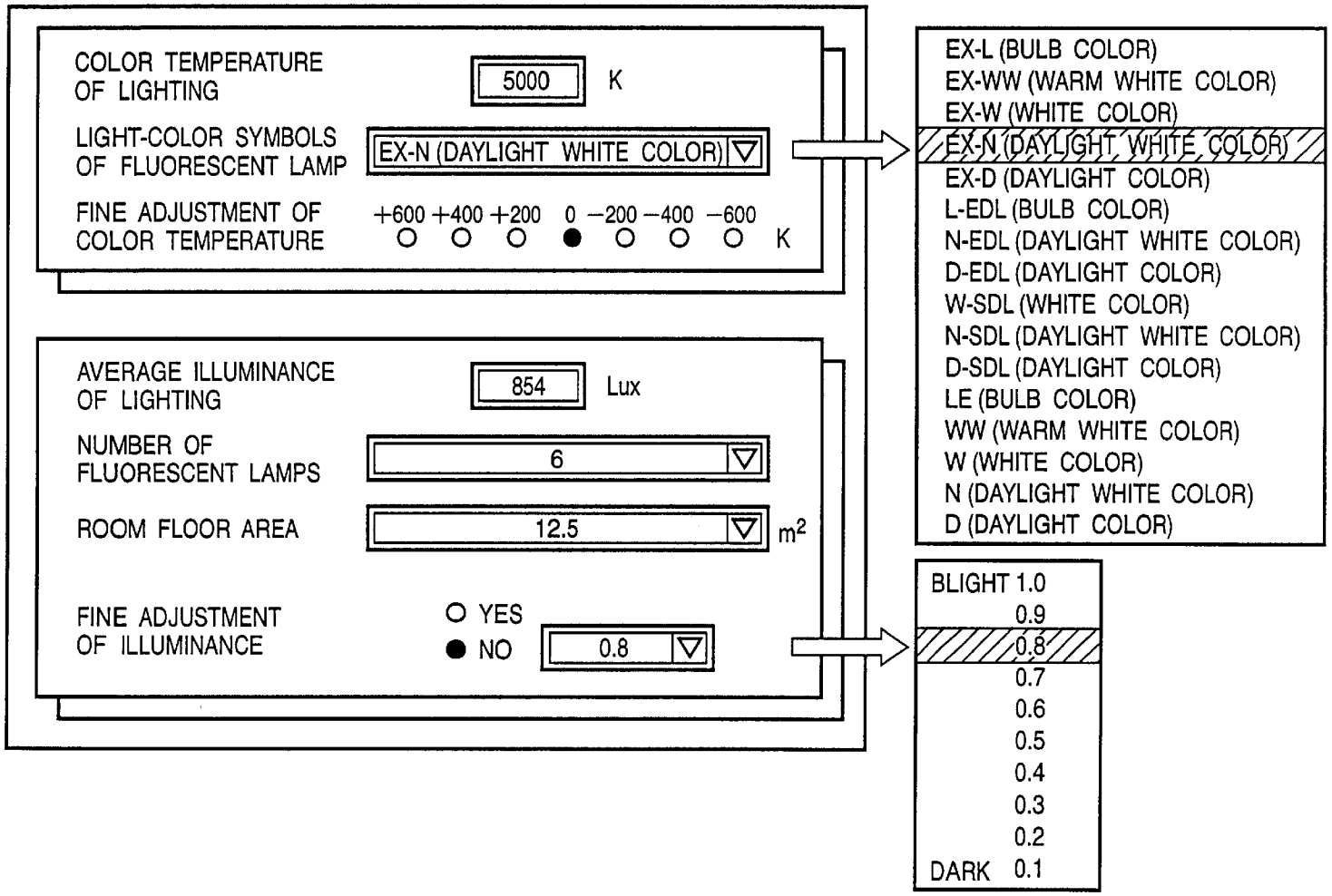
FIG. 4 is a diagram showing an example of a user interface for setting lighting conditions.

FIG. 4 is a diagram showing an example of a user interface used to set parameters for calculating the characteristics (lighting characteristics) of environmental light. The user interface is provided by the scanner utility 17. Examples of items set include light-color symbols serving as an illumination light-source condition of the fluorescent lamps in the room in which the printed matter read by the scanner 3 is observed (i.e., the room in which the scanner 3 has been installed), as well as the number of fluorescent lamps and the floor area of the room (the room illuminated by the fluorescent lamps), which are the conditions of the indoor lighting environment. By using this user interface to set the light-color symbols of a fluorescent lamp to, e.g., "EX-N (DAYLIGHT WHITE)", "5000" (K), which is indicated as the typical value of the corresponding correlated color temperature in the table of FIG. 2, is displayed as the color temperature of the lighting. By further setting the number of fluorescent lamps to "6" and the floor area of the room to "12.5" $m^2$ as the conditions of the lighting environment in the room, and by setting "0.8" as a fine-adjustment value of illuminance, the average illuminance of the indoor lighting is displayed as "854" (lux).

The user interface further provides items for finely adjusting color temperature and average illuminance of the above-described environmental light. Image data (described later) following color matching that takes environmental light into account is displayed (previewed) on the monitor 2 so that the user may make a visual confirmation, thereby making it possible to set parameters more accurately. Furthermore, the light-color symbols and fine-adjustment values, etc., of the fluorescent lamp can be selected from predetermined parameters and set by the user in the manner shown in FIG. 4.

<Processing for Calculating Lighting Characteristics>

In this embodiment, lighting characteristics can be calculated by setting parameters using the user interface shown in FIG. 4. Specifically, the correlated color temperature Tc (K) and light-source flux Φ (lm) are obtained from the set light-color symbols of the fluorescent lamp and, on the basis thereof, the lighting characteristics necessary for color matching processing according to the color appearance model of CIECAM97s, namely the relative tristimulus values XwYwZw of the lighting and luminance La (cd/m$^2$) of the adaptation visual field, are calculated.

Processing for calculating lighting characteristics in this embodiment will now be described in detail.

Figure 5:
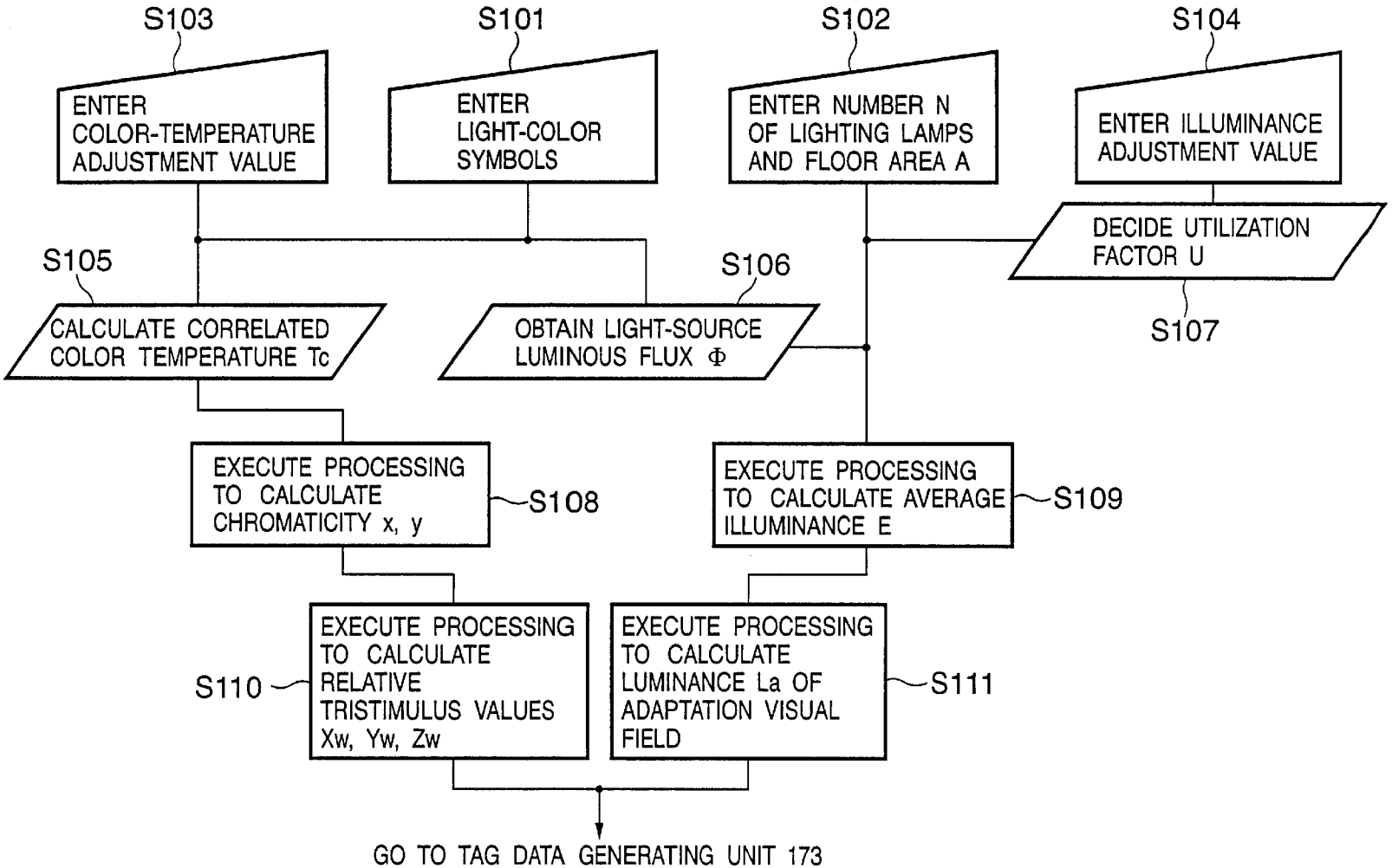
FIG. 5 is a flowchart illustrating processing for calculating lighting conditions.

FIG. 5 is a flowchart illustrating processing for calculating lighting characteristics based upon set parameters. This processing is controlled by the scanner utility 17.

First, the light-color symbols and color-temperature adjustment values of the fluorescent lamp are set as parameters via the user interface (S101, S103). Correlated color temperature Tc is calculated based upon these values (S105). More specifically, the lighting-condition parameter storage unit 171 is searched based upon the set light-color symbols to obtain the corresponding correlated color temperature, and the value of this correlated color temperature is subjected to an adjustment based upon the color-temperature adjustment value. The correlated color temperature Tc of the fluorescent lamp is thus estimated.

Chromaticity (x,y) corresponding to the correlated color temperature Tc is calculated based upon Equation (1) below (S108). A method of calculating chromaticity will be described next.

Figure 6:
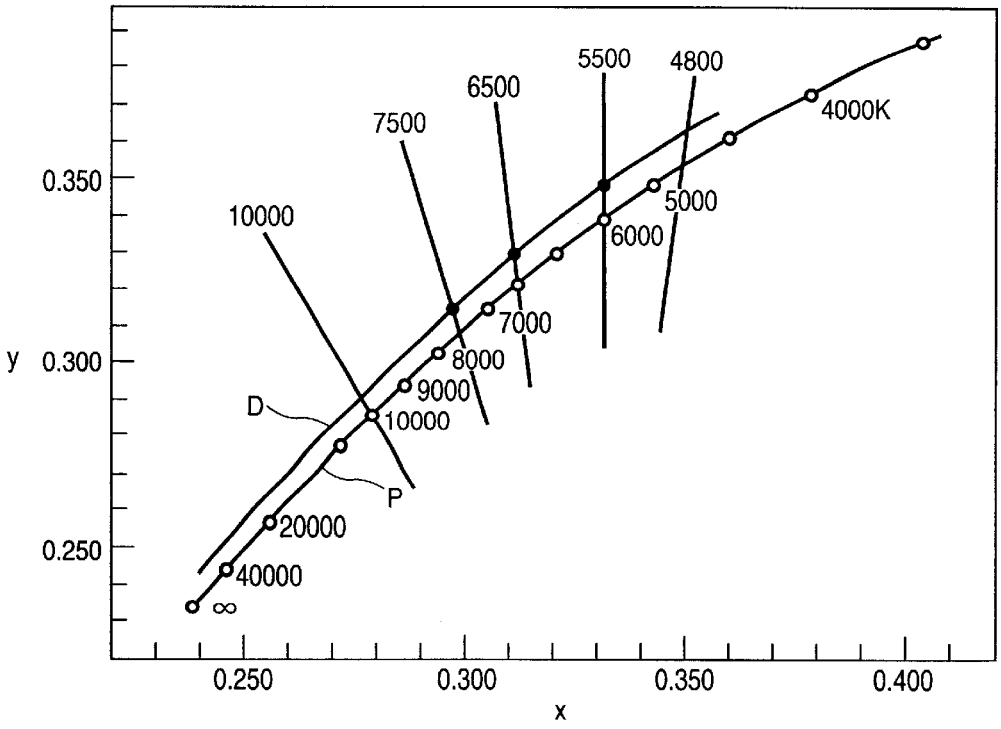
FIG. 6 is a diagram illustrating the relationship between a daylight trace and correlated color temperature.

FIG. 6 is a diagram illustrating the relationship between a daylight trace and correlated color temperature. In accordance with FIG. 6, chromaticity coordinates (x,y) of a CIE XYZ color system with regard to correlated color temperature Tc (K) of the fluorescent lamp are as indicated by curve D in FIG. 6. It will be understood that this curve generally resembles the CIE daylight trace (curve P in FIG. 6). Calculation of (x,y) based upon Tc employs experimental equations (1) below that are based upon observation data of the CIE. However, similar results are obtained also by using similar conversion equations or a look-up table.

$$x_D=-4.6070\cdot10^9/Tc^3+2.9678\cdot10^6/Tc^2+0.09911\cdot10^3/Tc+0.244063$$

$$y_D=-3.000\cdot x_D^2+2.870\cdot x_D-0.275 \quad (1)$$

The relative tristimulus values XwYwZw of the fluorescent lamp are obtained by converting the chromaticity values (x,y) to relative tristimulus values (X,Y,Z) based upon the conversion equations (2) below (S110).

$$Xw=100\cdot x_w/y_w$$

$$Yw=100$$

$$Zw=(1-x_w-y_w)\cdot100/y_w \quad (2)$$

The processing at steps S105, S108 and S110 is executed by the lighting parameter calculation unit 172 in the scanner utility 17.

The optimum light-source flux Φ is obtained by searching the lighting-condition parameter storage unit 171 based upon the light-color symbols entered at step S101

Similarly, the number N of fluorescent lamps, floor area A (S102) and the illuminance adjustment value (S104) are entered via the user interface shown in FIG. 4, and utilization factor U is decided based upon the illuminance adjustment value (S107). The utilization factor U is a coefficient between 0 and 1 decided by the aperture characteristic of the lighting fixture and the indoor reflection conditions, etc. In this embodiment, however, a lighting fixture used in the typical office (the fixture corresponds to glare classification V2) is taken as a default value and U=0.7 is used.

Average illuminance (lux) of indoor lighting is calculated in accordance with equations (2) below (S109):

$$E=\Phi\cdot N\cdot U\cdot M/A \quad (3)$$

Φ: light-source flux (lm)

N: number of light-source lamps

U: utilization factor (=0.7)

M: maintenance factor

A: floor area (m$^2$)

The average illuminance E is calculated based upon the flux Φ (lm) of the fluorescent lamp, the number N of fluorescent lamps and the floor area A (m$^2$), as indicated by equations (2) above. The maintenance factor M in equations (3) is a correction value based upon degree of deterioration of the fluorescent lamps. In this embodiment, M=1.0 holds.

The average illuminance E is converted to luminance La (cd/m$^2$) of the adaptation visual field in accordance with equations (4) below (S111).

$$L=E\cdot\rho/\pi$$

$$La=L\cdot0.2 \quad (4)$$

E=average illuminance

ρ: reflectivity of paper (about 0.9)

The processing of steps S106, S107, S109 and S111 also is executed by the lighting parameter calculation unit 172 in the scanner utility 17.

In this embodiment, a correlated color temperature correction equation and an illuminance correction equation relating to indoor lighting are defined as indicated by equations (5) in order to adjust an error between a characteristic value of predicted lighting conditions and an actually measured value.

$$T'c=Tc+\Delta Tc$$

Tc: correlated color temperature (K)

ΔTc: correction value (K)

$$E'=E\cdot\alpha \quad (5)$$

E: average illuminance (lux)

α: correction coefficient (O~1)

The relative tristimulus values Xw, Yw, Zw of lighting and the luminance La (cd/m$^2$) of the adaptation visual field are calculated as lighting characteristics, as mentioned above, and these are stored in the scanner profile storage unit 19 as viewing condition data of the scanner profile by the tag data generating unit 173.

In this embodiment, as described above, lighting conditions for printed matter, such as the light-color symbols of a fluorescent lamp, are set at steps S101 to S104, characteristic values of this lighting are calculated simply and accurately at steps S105 to S111 based upon the set lighting conditions, and the calculated characteristic values are fed back to the scanner profile as tag data.

<Color Matching Processing>

In this embodiment, optimum color matching that takes lighting into consideration is implemented by referring to a scanner profile that reflects lighting characteristics found through the procedure of FIG. 5.

Figure 7:
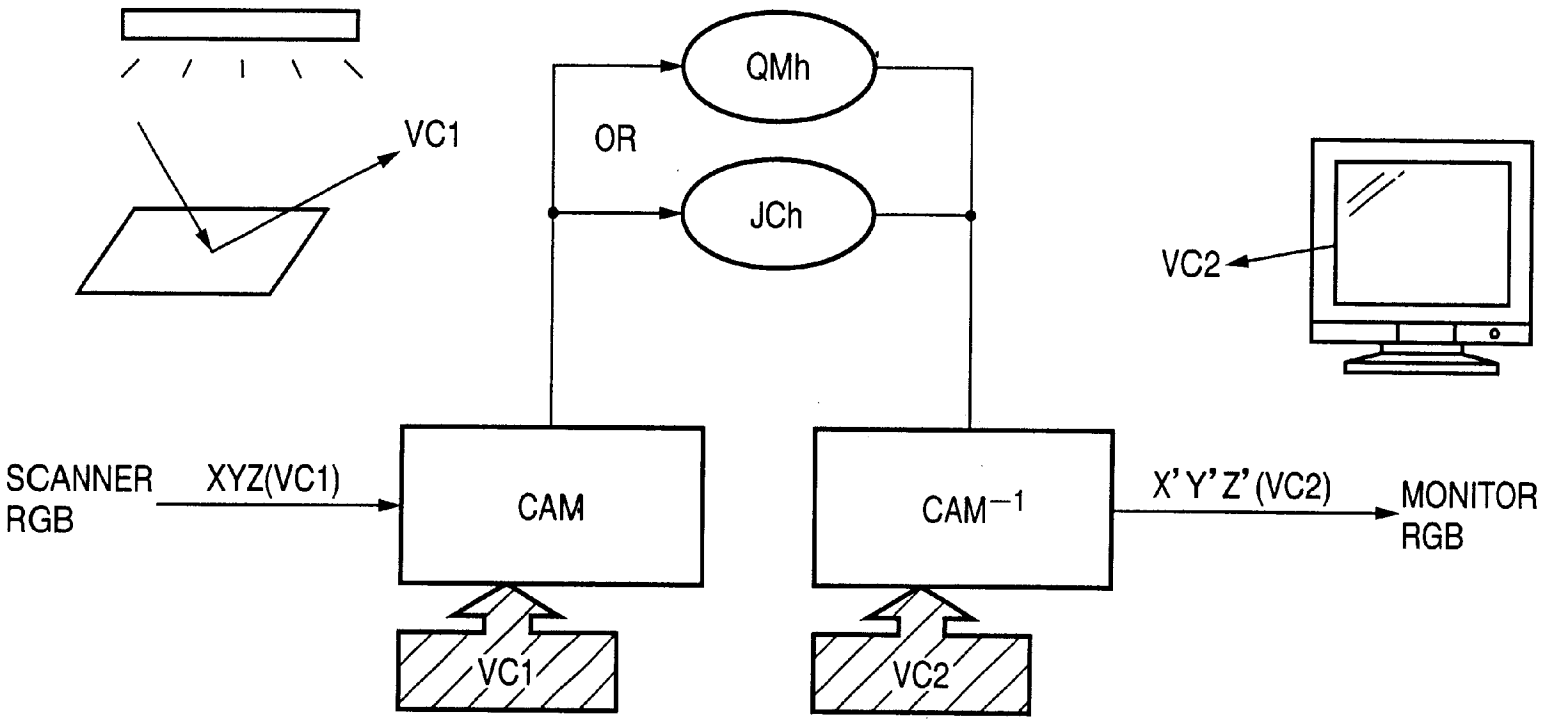
FIG. 7 is a diagram illustrating the essentials of color matching processing according to this embodiment.

FIG. 7 is a diagram illustrating the concept of color matching processing according to this embodiment. This processing is executed by the color matching module (CMM) 16. Though an example in which the color appearance model is in accordance with CIECAM97s will be described, this embodiment is applicable to other color appearance models as well.

Image data that has been read in by the scanner 3, i.e., scanner RGB data dependent upon the characteristics of the scanner, is converted to X, Y, Z values [XYZ (VC1) data], which is dependent upon the relative tristimulus values Xw, Yw, Zw of a fluorescent lamp in observation conditions (lighting conditions hereafter) for observing input printed matter, by referring to the scanner profile.

The lighting conditions VC1, which indicate the relative tristimulus values Xw, Yw, Zw of the fluorescent lamp and the luminance La (cd/$m^2$) of the adaptation visual field, has been stored in the scanner profile as tag data, as mentioned above. Accordingly, by performing a forward conversion of a color appearance model (CAM) by referring to the scanner profile, XYZ (VC1) data that is dependent upon lighting conditions is converted to data in color appearance space JCh (color appearance space relative to lighting conditions), which is independent of lighting conditions, or to data in absolute color appearance space QMh (absolute color appearance space that varies depending upon the magnitude of illuminance in the lighting conditions), which also is independent of lighting conditions.

A reverse conversion of the color appearance model (CAM) is applied to the data in the color appearance model space JCh or QMh, which is independent of the lighting conditions, by referring to the monitor profile that includes display conditions VC2 of the monitor 2 as tag data, whereby this data is converted to X'Y'Z' values [X'Y'Z' (VC2) data] corresponding to the monitor display conditions VC2. The X'Y'Z' (VC2) data is further converted to monitor RGB data, which is dependent upon the characteristics of the monitor 2, and the RGB data is output to the monitor 2.

Thus, in accordance with this embodiment as described above, suitable color matching that takes lighting into account is applied to image data read in the scanner 3 and faithful color reconstruction based upon printed matter is achieved on the monitor 2.

It should be noted that the present invention is not limited to the particulars described in this embodiment, and it is possible to modify the processing procedure, for example, within the scope of the gist of the invention.

By way of example, the color appearance model is not limited to CIECAM97s, and other schemes may be used.

Further, color matching is not limited to that between a scanner and a monitor, and the invention may be applied to color matching between other devices.

[Other Embodiments]

The present invention can be applied to a system constituted by a plurality of devices (e.g., a host computer, interface, reader, printer, etc.) or to an apparatus comprising a single device (e.g., a copier or facsimile machine, etc.).

Furthermore, it goes without saying that the object of the invention is attained also by supplying a storage medium (or recording medium) storing the program codes of the software for performing the functions of the foregoing embodiment to a system or an apparatus, reading the program codes with a computer (e.g., a CPU or MPU) of the system or apparatus from the storage medium, and then executing the program codes. In this case, the program codes read from the storage medium implement the novel functions of the embodiment and the storage medium storing the program codes constitutes the invention. Furthermore, besides the case where the aforesaid functions according to the embodiment are implemented by executing the program codes read by a computer, it goes without saying that the present invention covers a case where an operating system or the like running on the computer performs a part of or the entire process in accordance with the designation of program codes and implements the functions according to the embodiment.

It goes without saying that the present invention further covers a case where, after the program codes read from the storage medium are written in a function expansion card inserted into the computer or in a memory provided in a function expansion unit connected to the computer, a CPU or the like contained in the function expansion card or function expansion unit performs a part of or the entire process in accordance with the designation of program codes and implements the function of the above embodiment.

In accordance with the present invention, as described above, lighting characteristics used in color matching processing that employs a color appearance model can be detected simply and accurately.

Further, suitable color matching processing can be executed in conformity with detected lighting characteristics.

As many apparently widely different embodiments of the present invention can be made without departing from the spirit and scope thereof, it is to be understood that the invention is not limited to the specific embodiments thereof except as defined in the appended claims.

What is claimed is:

1. An image processing method for executing correction processing in accordance with a viewing condition when an image is observed using a color appearance model, comprising:

a rated-product number input step of inputting a rated-product number of a lighting lamp, which is used when an image is observed;

a lighting characteristic calculation step of calculating lighting characteristic values based upon the rated-product number; and a correction step of, on the basis of the lighting characteristics values, executing correction processing for the image using a color appearance model.

2. The method according to claim 1, wherein light-color symbols included in the rated-product number of the lighting lamp are input at said rated-product number input step.

3. The method according to claim 1, further comprising an adjustment value input step of inputting a manual command from a user for finely adjusting the lighting characteristic values.

4. The method according to claim 1, wherein the lighting characteristic values are relative tristimulus values of the lighting lamp.

5. The method according to claim 4, wherein said lighting characteristic calculation step includes calculating correlated color temperature based upon the rated-product number, calculating chromaticity based upon the correlated color temperature and calculating the relative tristimulus values based upon the chromaticity.

6. The method according to claim 5, wherein the correlated color temperature is a value based upon a rated-characteristic table of the lighting lamp.

7. The method according to claim 4, further comprising:

a lighting environment input step of inputting lighting environment conditions; and a luminance calculation step of calculating a luminance value of an adaptation visual field based upon the rated-product number and the lighting environment conditions;

wherein said correction step includes executing correction processing that uses a color appearance model that is based upon the relative tristimulus values and the luminance value of the adaptation visual field.

8. The method according to claim 7, wherein said luminance calculation step includes calculating luminous flux based upon the rated-product number, calculating average illuminance based upon the luminous flux and the lighting environment conditions, and calculating the luminance value of the adaptation visual field based upon the average illuminance.

9. The method according to claim 8, wherein the luminous flux is a value based upon a rated characteristic table of the lighting lamp.

10. The method according to claim 1, wherein the lighting lamp is a fluorescent lamp.

11. An image processing method for executing correction processing in accordance with a viewing condition when an image is observed using a color appearance model, comprising:

an input step of inputting illumination-light source condition and indoor lighting environment condition when an image is observed;

a lighting characteristic calculation step of calculating a lighting characteristic value based upon the illumination-light source condition and the indoor lighting environment condition; and a correction step of, on the basis of the lighting characteristics values, executing correction processing for the image using a color appearance model, wherein said illumination-light source condition includes an information on the illumination-light source which is used when an image is inputted, and wherein said indoor lighting environment condition includes a condition on arranging the illumination-light source.

12. The method according to claim 11, wherein the indoor lighting environment conditions include number of lighting lamps.

13. The method according to claim 11, wherein the indoor lighting environment conditions include a utilization factor.

14. The method according to claim 11, wherein the lighting characteristic value is a luminance value of an adaptation visual field.

15. The method according to claim 11, wherein said lighting characteristic calculation step includes calculating average illuminance based upon the indoor lighting environment conditions and calculating the luminance value of the adaptation visual field based upon the average illuminance.

16. The method according to claim 11, wherein lighting lamp is a fluorescent lamp.

17. An image processing apparatus for executing correction processing in accordance with a viewing condition when an image is observed using a color appearance model, comprising:

rated-product number input means for inputting a rated-product number of a lighting lamp, which is used when an image is observed;

lighting characteristic calculation means for calculating lighting characteristic values based upon the rated-product number; and correction means for, on the basis of the lighting characteristics values, executing correction processing for the image using a color appearance model.

18. An image processing apparatus for executing correction processing in accordance with a viewing condition when an image is observed using a color appearance model, comprising:

input means for inputting illumination-light source condition and indoor lighting environment condition when an image is observed;

lighting characteristic calculation means for calculating a lighting characteristic value based upon the illumination-light source condition and the indoor lighting environment condition; and correction means for, on the basis of the lighting characteristics values, executing correction processing for the image using a color appearance model, wherein said illumination-light source condition includes an information on the illumination-light source which is used when an image is inputted, and wherein said indoor lighting environment condition includes a condition on arranging the illumination-light source.

19. A program, which is executed by a computer, for implementing correction processing in accordance with a viewing condition when an image is observed using a color appearance model, comprising:

code of a rated-product number input step of inputting a rated-product number of a lighting lamp, which is used when an image is observed;

code of a lighting characteristic calculation step of calculating lighting characteristic values based upon the rated-product number; and code of a correction step of, on the basis of the lighting characteristics values, executing correction processing for the image using a color appearance model.

20. A recording medium on which the program set forth in claim 19 has been recorded.

21. A program, which is executed by a computer, for implementing correction processing in accordance with a viewing condition when an image is observed using a color appearance model, comprising:

code of an input step of inputting illumination light source condition and indoor lighting environment condition when an image is observed;

code of a lighting characteristic calculation step of calculating a lighting characteristic value based upon the illumination-light source condition and the indoor lighting environment condition; and code of a correction step of, on the basis of the lighting characteristics values, executing correction processing for the image using a color appearance model, wherein said illumination-light source condition includes an information on the illumination-light source which is used when an image is inputted, and wherein said indoor lighting environment condition includes a condition on arranging the illumination-light source.

22. A recording medium on which the program set forth in claim 21 has been recorded.

* * * * *

UNITED STATES PATENT AND TRADEMARK OFFICE

CERTIFICATE OF CORRECTION

PATENT NO. : 6,816,168 B2 
DATED : November 9, 2004
INVENTOR(S) : Kumada et al.

It is certified that error appears in the above-identified patent and that said Letters Patent is hereby corrected as shown below:

Title page,
Item [56], References Cited, after "358/530", insert
-- FOREIGN PATENT DOCUMENTS
JP 9-214187 8/1997
JP 11-232444 8/1997 --

Column 5,
Line 65, "S101" should read -- S101. --.

Signed and Sealed this

Eighth Day of March, 2005

JON W. DUDAS
*Director of the United States Patent and Trademark Office*